United States Patent [19]

Christian

[11] 4,217,086

[45] Aug. 12, 1980

[54] EXTRUDER WITH SEALING DIE FOR ABRASIVE MATERIAL

[75] Inventor: Miles W. Christian, Plymouth, Ohio

[73] Assignee: Plymouth Locomotive Works, Inc., Plymouth, Ohio

[21] Appl. No.: 874,883

[22] Filed: Feb. 3, 1978

[51] Int. Cl.[3] ..... A01J 21/02

[52] U.S. Cl. ..... 425/376 R; 425/376 B; 425/378 R; 425/384; 425/388; 425/402

[58] Field of Search ..... 425/376 R, 376 A, 376 B, 425/378 R, 379 R, 384, 388, 402, 203, 202, 205, 207

[56] References Cited

U.S. PATENT DOCUMENTS

| | | | |
|---|---|---|---|
| 1,296,472 | 3/1919 | Brand | 264/102 |
| 1,898,381 | 2/1933 | Mooney | 425/384 |
| 1,987,359 | 1/1935 | Brown | 264/102 |
| 2,078,565 | 4/1937 | Durst et al. | 264/102 |
| 2,572,063 | 10/1951 | Skipper | 425/376 |
| 2,617,167 | 11/1952 | Johnson | 425/376 |
| 3,067,462 | 12/1962 | Kullgren | 425/376 |
| 3,225,715 | 12/1965 | Page | 425/376 |

*Primary Examiner*—Donald J. Arnold
*Attorney, Agent, or Firm*—Maky, Renner, Otto & Boisselle

[57] ABSTRACT

An improved seal is provided at the entrance of a de-airing chamber, which removes air from abrasive particulate matter as it is fed to an auger that forces the same though an extruder die to form an extrusion. The seal includes a sealing die whose wall is coaxial to the travel direction of the particulate matter entering the chamber and a sealing core that has flights for directly forcing the particulate matter through the die into the chamber while the particulate matter cooperates with the sealing die and sealing core to block the escape of vacuum from such chamber. Steam or other lubricant may be injected into the particulate matter at or upstream of the seal to facilitate the flow of particulate matter through the seal. Fluid, such as steam, also may be injected directly into the particulate matter at the pug mill as an additional lubricant and/or as an activator to enhance the binding characteristics of a binder material combined with the particulate matter.

23 Claims, 3 Drawing Figures

EXTRUDER WITH SEALING DIE FOR ABRASIVE MATERIAL

BACKGROUND OF THE INVENTION

The present invention generally relates to extruding machines and methods for extruding material that has an abrasive characteristic.

As used herein, "extrude" means to force, press, push out, shape, or the like a material by forcing the same through a die. An "extruder" or an "extruding machine" means an apparatus for performing the act of extruding. Moreover, "extrusion" means an article or material produced by the use of an extruder, and a "fresh extrusion" or "green ware" means an extrusion that has just been extruded. "Extrusion material" means the ingredients being extruded. "Fluid" is used in its generic sense to mean either a liquid or a gas or other material that has fluid-like properties, e.g. capable of flowing.

A conventional extruder is exemplified by one sold under model type YX-8 by Plymouth Locomotive Works, Inc., Plymouth, Ohio. Such extruder includes a dual shaft plug mill in which the extrusion material is mixed and from which the extrusion material is delivered via a seal to a vacuum chamber where air is removed from the extrusion material to increase its uniformity, to reduce air bubbles in the extrusion, and the like. The auger, auger housing, and extrusion material therein provide a seal at the extrusion material outlet from the vacuum chamber to prevent escape of the vacuum therefrom. The seal at the entrance to the vacuum chamber is formed by a hollow tapered, e.g. truncated conical, sealing die and an oppositely tapered sealing core between which is defined a tapered volume that has a wide entrance into which extrusion material is driven from the pug mill by a sealing auger and a narrow exit through which the extrusion material is delivered to the entrance of the vacuum chamber. The extrusion material effectively is compressed in such tapered volume and cooperates with the tapered sealing die and core to provide the seal function blocking escape of vacuum from the vacuum chamber.

It has been found that relatively abrasive extrusion material sometimes has difficulty passing through such seal to the extent that a seizure is encountered which may damage the extruder. Accordingly, there is a need to facilitate the delivery of abrasive extrusion material into the vacuum chamber of an extruder while maintaining an effective seal at the entrance to such chamber.

In the past, to keep the extruder and extrusion material warm steam jackets were placed about one or more extruder components so that heat from steam in such jackets would provide warmth. However, such heating system was relatively inefficient since the outside of the steam jacket was exposed to ambient conditions and, therefore, itself lost heat to the ambient environment.

SUMMARY OF THE INVENTION

The invention will be described in detail below with reference to the extruding of coal fines, which is a particulate coal material usually considered a waste material in the past, in order to form a solidified extrusion thereof utilizing the method and apparatus of the invention thereby to create a useful coal product. A particle of coal fines may be of a size on the order of about ¼ inch to about 50 mesh or may be even larger or smaller than such range as distinguished, though, from chunks of coal that usually have a cross sectional dimension exceeding one inch. Coal fines are a relatively abrasive material compared, for example, to clay, which is a material that is often extruded. However, it will be appreciated that the method and apparatus of the invention may be employed in extruding other materials, including clay, and particularly such other materials that have a relatively abrasive characteristic.

Thus, in accordance with the present invention the delivery of a particulate material through a seal at the entrance of a vacuum chamber for an extruder is facilitated. Such facility is obtained, on the one hand, by a cooperative sealing die and sealing core, wherein the major wall of each is generally coaxial with the travel direction of the particulate material through the die and the latter has flights to drive the particulate material directly through the die. Such delivery also is facilitated in accordance with one embodiment of the invention by the injection of a lubricating fluid into the particulate material at the seal generally slightly upstream of the sealing die and sealing core. Moreover, the sealing die includes a plurality of axial bars creating a series of flute-like recesses therebetween to create turbulence in the material passing through the seal. In the vacuum chamber the extrusion material is uniformly shredded, air is removed, and the particulate matter is fed to the auger.

In accordance with another aspect of the invention, fluid, such as steam, is injected directly into the pug mill, on the one hand, to provide a lubricating function as the particulate matter is moved through the pug mill and seal and/or, on the other hand, to enhance the activation of a binder material that is combined or mixed with the particulate matter. The binder and particulate matter form a mixture of extrusion material, and after such material is extruded through the extruder die, the binder binds the particulate matter ingredient to hold the particles thereof in relatively fixed relation to hold the shape of the extrusion. Such binder activation may be provided by the moisture content of the steam that enhances the activation of a water activated binder or, alternatively, the heat of the injected steam or the like may soften a heat responsive binder material to facilitate its coating of the particles to be bound thereby.

With the foregoing in mind it is a primary object of the invention to provide an extruder and a method for extruding that are improved in the noted respects.

Another primary object is to facilitate the extruding of coal or coal-like material, such as, for example, coal fines and of other relatively abrasive materials.

Another object is to facilitate the extruding of relatively abrasive material.

An additional object is to facilitate the delivery of extrusion material, particularly abrasive extrusion material, through a seal in an extruder.

A further object is to inject fluid directly into extrusion material as it passes through an extruder.

Still another object is to provide enhanced activation of a binder material in an extruder.

Still an additional object is to prevent seizure in an extruder, especially when relatively abrasive material is being extruded.

These and other objects and advantages of the present invention will become more apparent as the following description proceeds.

To the accomplishment of the foregoing and related ends, the invention, then, comprises the features herein-after fully described in the specification and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figures 1, 2, 3:
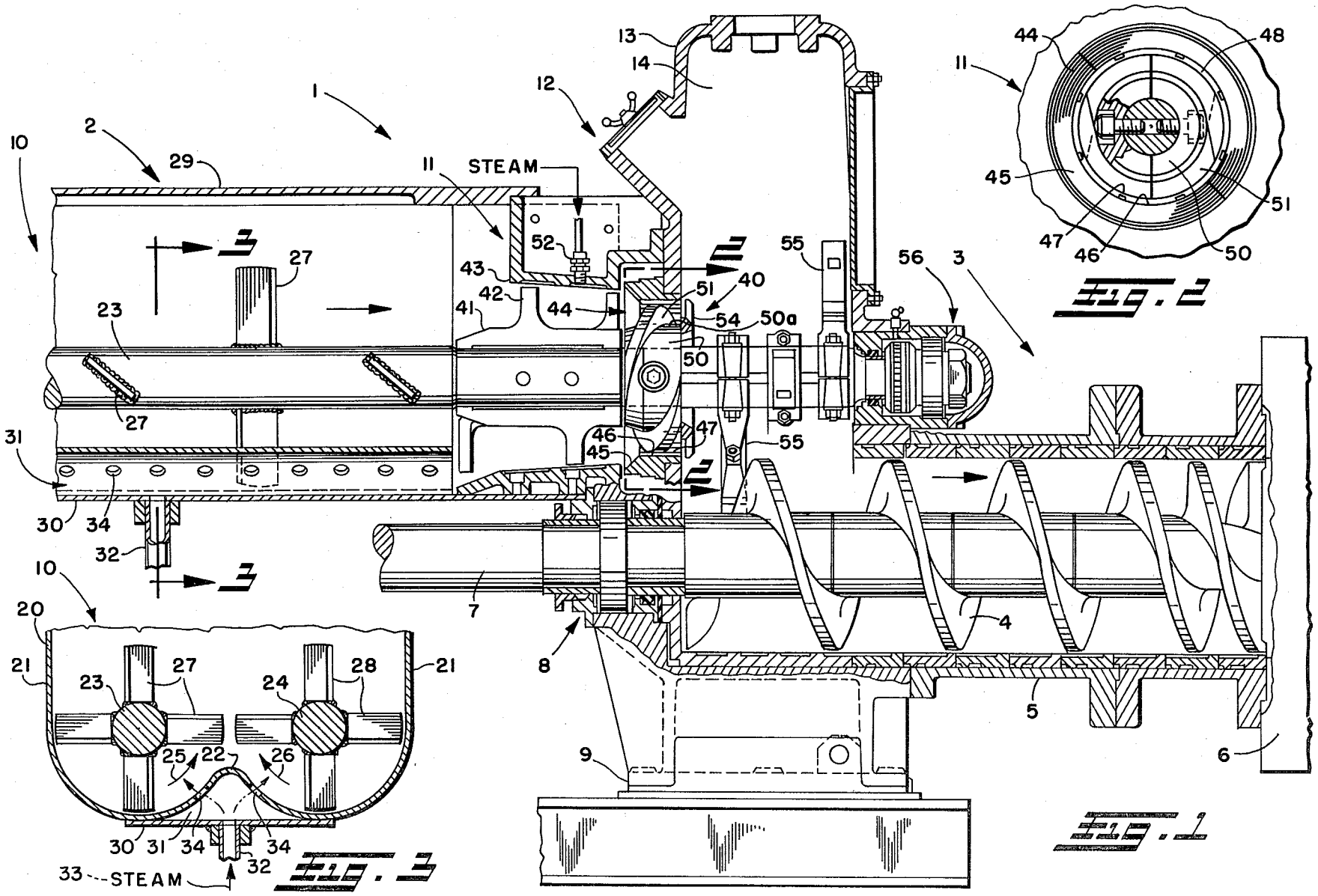
FIG. 1 is a partial side view, partly broken away in section, of an extruder in accordance with the present invention.
FIG. 2 is a view, which is partly in section, looking generally in the direction of the arrows 2—2 in FIG. 1 showing the sealing die and sealing core.
FIG. 3 is a section view looking generally in the direction of the arrows 3—3 in FIG. 1 showing the pug mill and steam injection manifold thereof.

Referring in detail initially to FIG. 1, an extruder in accordance with the present invention is generally indicated at 1. The extruder 1 includes an input system 2 and an output system 3, the latter including a conventional auger 4, auger housing 5, and extruder die 6. Rotation of the auger 4 in its housing 5 forces extrusion material delivered from the input system 2 through the extruder die 6 to form an extrusion in conventional manner. Rotation of the auger 4 is obtained via an auger drive shaft 7, which is coupled at one end through the housing 5 to the auger via a substantially fluid-tight bearing 8 and at the other end to a conventional drive, not shown. One or more stands 9 provide support for the various portions of the extruder 1.

The input system 2 includes a pug mill 10, a seal 11, and a de-airing apparatus 12. The de-airing apparatus 12 includes a vacuum housing 13 in which a vacuum chamber 14 is defined. A vacuum applied to the vacuum chamber 14 by a conventional vacuum source, not shown, draws air or other gases out of the extrusion material passing through the de-airing apparatus from which the extrusion material is fed to the auger. By so removing air and other gases, the consistency of the extrusion material fed to the auger is maintained relatively uniform and the number of air bubbles and the like in the extrusion formed by the output system 3 is minimized. Ordinarily the bearing 8 and the extrusion material in cooperation with the auger 4 and auger housing 5 provide a satisfactory seal at the exit of the de-airing apparatus 12 to preclude any substantial escape or loss of vacuum via such exit where the extrusion material is fed to the auger.

As is shown in FIG. 3, the pug mill 10 includes a W-shape trough 20 having side walls 21 and a slightly raised central divider 22. Pug shafts 23, 24 on opposite sides of the divider 22 are rotatably driven by a conventional drive, not shown, in the direction of arrows 25,26 to rotate pug knives 27, 28. A cover 29 positioned above the side walls 21 covers the top of the pug mill.

Extrusion material is delivered into the pug mill at its left hand end relative to the illustration of FIG. 1. The rotating pug knives 27, 28 mix the extrusion material and move it along through the pug mill to the seal 11. In the preferred embodiment, the extrusion material is comprised of a mixture of coal fines on the order of, for example, 50 mesh to about ¼ inch mixed with about 5% by weight of a binder material, such as a water activated binder, a coal byproduct or petroleum byproduct binder, or the like. The percentage amount of binder relative to the coal fines may vary depending on the binding characteristics of the binder, the particle size of the coal fines, the desired strength of the extrusion produced by the extruder 1, etc., and may be varied, as desired. Thus, the extrusion material, such as the mixture of coal fines and binder, is well mixed in the pug mill 10 when it is finally delivered to the seal 11.

A plate 30 is fastened, for example welded, to the bottom of each hump of the W-shape trough 20, as seen in FIGS. 1 and 3, to create a manifold 31 beneath the central divider wall 22. A steam input line and fitting 32, which is connected to a supply of steam or other fluid if desired generally represented at 33 leads into the manifold 31, and a plurality of openings 34 pass fluid from the manifold into the trough 20. In the preferred embodiment the fluid provided through the manifold 31 is steam. Accordingly, if the extrusion material in the trough is a mixture of coal fines and water activated binder, the moisture in the steam enhances the activation of such binder to assure its thorough mixing with the particles of coal fines and coating of the same. The steam also warms such material to avoid freezing, for example. Alternatively, if the extrusion material is a mixture of coal fines and a coal byproduct or petroleum byproduct binder, such as coal tar, asphalt, or the like, the heat from the steam reduces the viscosity of the binder, for example, to enhance its fluent contact with the coal fines particles.

The seal 11 is at the end of the pug shaft 23, and it will be appreciated that a similar seal will be located at the end of the pug shaft 24, with each seal providing for the delivery of extrusion material through respective entrances or inlets 40 into the vacuum chamber 14 while maintaining a seal at such entrance blocking the escape of vacuum. The seal 11 includes a sealing auger 41 having flights 42 that move the extrusion material through the sealing auger housing 43 to the sealing die 44. The sealing auger housing 43 is only relatively gradually sloped in order to avoid any seizure due to compaction of the relatively abrasive extrusion material. The sealing die 44 has a short axial length sloping input wall 45 and a major wall 46 that is substantially coaxial, i.e. parallel, with the pug shaft 23 and with the travel direction of the extrusion material through the sealing die into the vacuum chamber 14. As seen most clearly in FIG. 2, a plurality of linear bars 47 is mounted on the major wall 46 coaxially with the pug shaft 23 to form a plurality of flute-like recesses 48. The sealing core 50, which is formed in two halves that are fastened on the pug shaft 23, has a major wall portion 50*a* that is parallel to that of the sealing die, thereby forming an annular cylinder, as shown, and flights 51 that push the extrusion material through the sealing die while the bars 47 provide a turbulent effect to avoid substantial compaction of the extrusion material in the sealing die 44, thus avoiding a subsequent seizure thereat. The rotating sealing core 50 pushes the extrusion material through the sealing die 44 to the entrance 40 of the vacuum chamber 14.

It has been discovered that the relatively compact extrusion material forms in the relatively untapered volume of the sealing die and sealing core, as shown, an effective seal to block the escape of vacuum from the chamber 14. Moreover, the axially straight walls of the sealing die 44 and sealing core, i.e. without the significantly restricted taper of prior art sealing dies and cores, and the flights 51 on the sealing core 50 facilitate the movement of extrusion material through the sealing die into the vacuum chamber 14.

Moreover, at the seal 11 one or more steam input lines and fittings represented at 52 may be coupled, for example, through the sealing auger housing 43 to supply fluid directly to the extrusion material in the seal 11. Such fluid may be, for example, a lubricant such as, for example, steam from a supply 53. Such lubricant further facilitates the flow of extrusion material through the seal 11. The fluid input provided at the line and fitting 52 also may be employed to provide the binder activating function described above with reference to the fluid provided in the fitting 32 to the manifold 31 of a pug mill 10.

The extrusion material entering the vacuum chamber 14 from the sealing die 44 and sealing core 50 is in the form of mini-extrusions that are shredded in conventional manner by shredder blades 54, which are mounted on the pug shaft 23, and in the vacuum chamber 14 a substantial amount of the air and other gases is removed from such extrusion material. Conventional feeder knives 55, which are also mounted on the pug shaft 23, feed such de-aired extrusion material directly to the auger 4, which pushes the same through the extruder die 6 to form the extrusion. The pug shaft 23 is supported at a substantially fluid-tight bearing 56 which further assures the relatively fluid-tight integrity of the vacuum chamber 14.

In view of the foregoing it will be appreciated that the extruder 1 of the present invention provides and may be used for the extruding of relatively abrasive extrusion material. Fluid may be injected into the extrusion material to activate the binder and/or to facilitate movement of the extrusion material through a sealing die and sealing core into a vacuum chamber, which effects a de-airing of the extrusion material to enhance the uniformity thereof and of the final extrusion formed by the extruder. In accordance with the method of the invention the extrusion material is moved by a driving force that is applied directly to the extrusion material by the sealing core 50 at the sealing die 44 to assure movement of the extrusion material through the extruder without seizure while allowing for the de-airing process to take place without substantial loss of vacuum in the vacuum chamber 14. The extrusion material, then, is extruded by the auger 4 through the extruder die to form a fresh extrusion.

The embodiments of the invention in which an exclusive property or privilege is claimed are defined as follows:

1. An extruder, comprising auger means for forcing extrusion material through an extruder die to form an extrusion, and input means for delivering extrusion material to said auger means, including de-airing means for removing air from said extrusion material prior to delivery to said auger means and seal means upstream of said de-airing means for sealing the extrusion material inlet to the latter, said seal means including a flighted sealing core to push extrusion material into said de-airing means, and a sealing die, said sealing core being positioned within an open part of said sealing die to push extrusion material therethrough, and said sealing core and sealing die each including a major wall portion generally parallel with the travel direction of extrusion material through said sealing die.

2. The extruder of claim 1, said major wall portions being substantially cylindrical.

3. The extruder of claim 2, said sealing die having a sloping input wall forming a relatively wide entrance receiving extrusion material and sloping to a narrower exit to said major wall portion.

4. An extruder as set forth in claim 1, said sealing die including means on a wall thereof for imparting turbulence to the extrusion material pushed therethrough.

5. The extruder of claim 4, said means for imparting turbulence comprising bar-like members positioned on said wall portion generally coaxial with such travel direction.

6. The extruder of claim 4, further comprising shredder means for shredding extrusion material delivered from said seal means into said de-airing means.

7. The extruder of claim 1, said seal means further comprising sealing auger means for pushing extrusion material into said seal means.

8. The extruder of claim 7, further comprising means for injecting fluid into extrusion material as it passes through said seal means.

9. The extruder of claim 8, said means for injecting comprising means for injecting steam into said extrusion material at said sealing auger.

10. An extruder, comprising auger means for forcing extrusion material through an extruder die to form an extrusion, and input means for delivering extrusion material to said auger means, including de-airing means for removing air from said extrusion material prior to delivery to said auger means and seal means upstream of said de-airing means for sealing the extrusion material inlet thereto, said seal means including a sealing die and a cooperative sealing core, said sealing die and sealing core forming a restricted path for travel of said extrusion material into said de-airing means, whereby said extrusion material passing therethrough forms such seal to prevent the escape of vacuum from said de-airing means, and said sealing die and sealing core each having a major wall portion that is generally parallel with the travel direction of extrusion material through said sealing die.

11. An extruder, comprising auger means for forcing extrusion material through an extruder die to form an extrusion, input means for delivering extrusion material to said auger means, said input means including de-airing means for removing air from said extrusion material prior to delivery to said auger means, and seal means upstream of said de-airing means for sealing the extrusion material into to the latter to block the escape of vacuum therefrom, and fluid coupling means for coupling fluid to said input means for delivery directly into said extrusion material, said fluid coupling being connected proximate said seal means to deliver fluid to said extrusion material for facilitating the flow of the latter through said seal means while maintaining the integrity of said seal means.

12. The extruder of claim 11, further comprising steam supply means for supplying steam as said fluid.

13. The extruder of claim 11, wherein said fluid coupling means comprises means for coupling a lubricating fluid to said input means.

14. The extruder of claim 13, said seal means comprising a sealing die and a sealing core cooperable to provide a path restriction through which the extrusion material flows in compacted relation to maintain the integrity of said seal means, said seal means further comprising a sealing auger means for delivering extrusion material to said sealing die and sealing core, and said coupling means being connected at said sealing auger means to deliver fluid to extrusion material at said sealing auger.

15. The extruder of claim 14, said sealing core having flights to push extrusion material through said sealing die and said sealing die and sealing core each having a major wall portion positioned generally parallel to the travel direction of extrusion material through said sealing die.

16. The extruder of claim 15, further comprising means in said sealing die for producing turbulence in the extrusion material passing therethrough.

17. An extruder, comprising auger means for forcing extrusion material through an extruder die to form an extrusion, input means for delivering extrusion material to said auger means, said input means including a pug mill, and fluid coupling means for coupling fluid to said input means for delivery directly into said extrusion material, said fluid coupling means including manifold means for delivering fluid into said pug mill along a substantial length thereof.

18. The extruder of claim 17, wherein said extrusion material includes a binder and said fluid coupling means couples a fluid that activates said binder.

19. The extruder of claim 18, wherein said fluid imparts heat to activate said binder.

20. The extruder of claim 18, wherein said fluid provides moisture to activate said binder.

21. The extruder of claim 18, further comprising steam supply means for supplying steam as said fluid.

22. The extruder of claim 17, wherein said pug mill has a W-shape trough, a plate secured to the bottom of said trough and forming said manifold means therewith, and holes in said trough fluidically coupling said manifold means with the interior of said trough for delivery of fluid from said manifold means into said trough.

23. The extruder of claim 22, wherein said pug mill includes two pug shafts with pug knives mounted thereon for mixing extrusion material in said trough, and wherein said manifold means and openings are positioned to provide fluid into said extrusion material mixed by both of said pug shafts and pug knives.

* * * * *